US007780553B2

(12) United States Patent
Palmer

(10) Patent No.: US 7,780,553 B2
(45) Date of Patent: Aug. 24, 2010

(54) GOLF PRACTICE APPARATUS

(76) Inventor: Andrew D. Palmer, P.O. Box 22, Fowlerville, MI (US) 48836

( * ) Notice: Subject to any disclaimer, the term of this patent is extended or adjusted under 35 U.S.C. 154(b) by 0 days.

(21) Appl. No.: 12/313,895

(22) Filed: Nov. 25, 2008

(65) Prior Publication Data

US 2010/0130300 A1 May 27, 2010

(51) Int. Cl.
*A63B 57/00* (2006.01)
*A63B 69/36* (2006.01)

(52) U.S. Cl. ..... 473/396; 473/386; 473/387

(58) Field of Classification Search ..... 473/387, 473/391, 392, 393, 396, 397, 398, 399, 400, 473/401, 402, 403, 406, 386
See application file for complete search history.

(56) References Cited

U.S. PATENT DOCUMENTS

| | | | | | |
|---|---|---|---|---|---|
| 1,679,579 | A | | 8/1928 | Lundy | |
| D152,218 | S | | 12/1948 | Reifman | |
| 2,531,470 | A | | 11/1950 | Rickard | |
| 2,839,304 | A | * | 6/1958 | Lerick | 473/397 |
| 3,414,268 | A | | 12/1968 | Chase | |
| 3,516,664 | A | | 6/1970 | Brennan | |
| 3,559,998 | A | | 2/1971 | Kelly | |
| 3,633,919 | A | * | 1/1972 | Liccardello | 473/386 |
| 3,899,179 | A | * | 8/1975 | Vlach | 473/218 |
| 3,966,214 | A | * | 6/1976 | Collins | 473/397 |
| 4,645,208 | A | * | 2/1987 | Morabeto | 473/397 |
| 4,786,054 | A | * | 11/1988 | Keys | 473/268 |
| 4,893,818 | A | | 1/1990 | Liccardello | |
| 5,242,170 | A | * | 9/1993 | Ward | 473/396 |
| 5,492,323 | A | | 2/1996 | Lee | |
| 6,062,989 | A | | 5/2000 | Wagner | |
| 6,086,486 | A | | 7/2000 | Murphy | |
| 6,102,811 | A | | 8/2000 | Henry | |
| D434,817 | S | | 12/2000 | Cole, Jr. | |
| 6,514,151 | B2 | * | 2/2003 | Delaplane | 473/268 |
| 6,783,470 | B2 | | 8/2004 | Lee | |
| 6,942,583 | B2 | | 9/2005 | Syu | |
| 7,011,586 | B2 | | 3/2006 | Toyosawa et al. | |
| 7,374,501 | B2 | * | 5/2008 | Lu | 473/396 |
| 7,494,429 | B2 | * | 2/2009 | Lee | 473/396 |
| 2003/0181262 | A1 | * | 9/2003 | Lee | 473/396 |
| 2004/0132554 | A1 | | 7/2004 | Schulze | |
| 2005/0233837 | A1 | | 10/2005 | Jung | |
| 2006/0058120 | A1 | | 3/2006 | Anton | |

* cited by examiner

*Primary Examiner*—Nini Legesse
(74) *Attorney, Agent, or Firm*—Mikhail Murshak; Steven M. Parks; Ian C. McLeod

(57) ABSTRACT

Golf training apparatus comprises a base having an opening through which an anchor member passes for embedding in the ground. The anchor member and the base have engageable and disengageable retainers which respectively enable and prevent separation thereof. The anchor member is coupled to a ball support in such manner as to enable the ball support to provide support for a golf ball and to rock relative to the anchor member in response to the striking of the ball or its support by a golf club. The coupling between the ball support and the anchor member is resiliently elastic, thereby enabling automatic recovery of the ball support member to its ball-supporting condition following the execution of a stroke.

21 Claims, 1 Drawing Sheet

GOLF PRACTICE APPARATUS

This invention relates to apparatus especially adapted for use in facilitating a person's practicing and improving his golf stroke.

BACKGROUND OF THE INVENTION

In developing and maintaining a proper golf swing it is customary for the golfer to use a golf club in a practice area to strike successive golf balls and thereby become more proficient in executing a proper golf swing. In those instances in which the golfer uses a golf club for hitting a ball from atop a tee it is not uncommon for the tee to be broken and/or dislodged from the ground by engagement of the golf club with the ball and its supporting tee during the execution of a swing. Having to replace a dislodged or broken tee is burdensome and takes away from the time otherwise available for practice.

Some of the practice devices of the prior art have supports which simulate tees for supporting golf balls during a practice session. Some of such supports have objectionable characteristics such as being of such flimsy nature as to require frequent replacement. Others of such devices provide more resistance to golf club movement than is desirable, thereby precluding the player is experiencing the feel generated by the movement of a golf club into engagement with the ball during a proper stroke.

The placement of a golfer's feet in relation to the position of the ball during the execution of a stroke has an effect on the flight of a struck ball. It is desirable, therefore, to make possible an arrangement by means of which a golfer may learn where to position his feet during successive strokes so as to enable him to practice golf shots which produce different results according to the placement of the feet.

Apparatus constructed in accordance with the invention overcomes the objectionable characteristics referred to above and facilitates the golfer's making specific golf strokes.

SUMMARY OF THE INVENTION

Apparatus constructed in accordance with the invention comprises a base which may be placed upon the ground or mat in a golf practice area. The base has length, width, and thickness dimensions of such nature that the base may provide support for an anchor member having a stem which extends through an opening in the base and terminates at one end in a point which may be embedded in the ground to anchor the base to the ground. The opposite end of the anchor member extends above the level of the base and terminates in an enlargement which has an upwardly facing socket therein. Encircling the enlargement and in stretched condition is one end of a resiliently elastic coupling sleeve within which is partially accommodated a ball support member having one end thereof rotatably accommodated in the socket and having at its other end an upwardly concave upper surface for the support of a golf ball.

The stem of the anchor member is provided with means for preventing separation of the anchor member from the base except when such separation is desired.

The sleeve couples the support member to the anchor member enlargement in such manner as to enable a moving golf club head to strike both the ball supported on the ball support and the coupling sleeve in which the ball support member is accommodated. The arrangement is such that the feel associated with the striking of a ball on the practice apparatus is similar to that when a ball supported atop a tee embedded in the ground is struck. However, since the coupling sleeve is elastically resilient, the two parts of the ball supporting apparatus can move relative to each other without separating. Accordingly, the ball support is not dislodged from the anchor member during the making of the stroke. Further, the elasticity of the coupling sleeve enables the relatively movable parts of the ball support and the anchor member to reposition themselves automatically following the execution of a stroke and in condition to support a ball for a subsequent stroke.

The base member preferably is tapered in a direction toward that end thereof which is opposite the direction taken by a golf club during a stroke. Such taper minimizes the possibility that the club will strike and move the base. The taper also facilitates placing a ball on the base by means of a club head in a position to be struck by the club head.

The base member may be of such area as to enable indicia such as lines to be provided and which diverge from one edge of the base in directions which make it possible for a golfer to place his feet in any selected one of a number of preferred positions during the execution of a stroke. The base member may include other indicia to facilitate a user's swinging the golf club along a path defined by such indicia.

THE DRAWINGS

Apparatus constructed in accordance with the invention is illustrated in the accompanying drawings wherein.

THE PREFERRED EMBODIMENT

Figure 1:
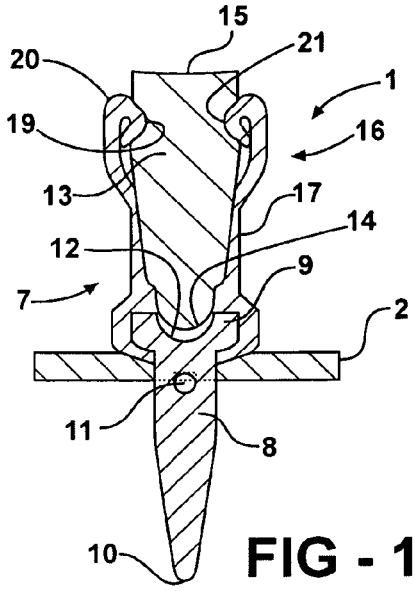
FIG. 1 is a vertical sectional view of one embodiment of training apparatus having a base member in assembled relation with an anchor member and a golf ball supporting member.
Figure 2:
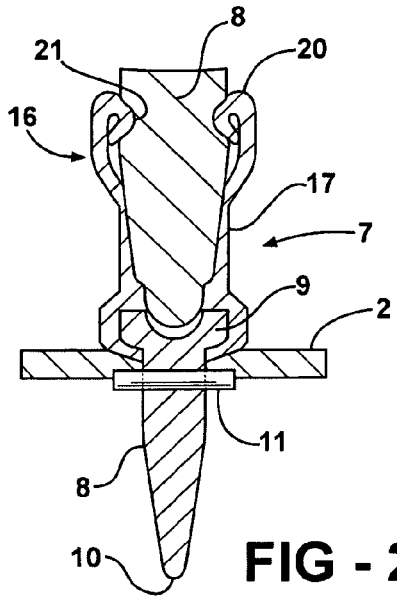
FIG. 2 is a view like FIG. 1, but with the ball supporting member rotated through 90° about a vertical axis.
Figure 3:
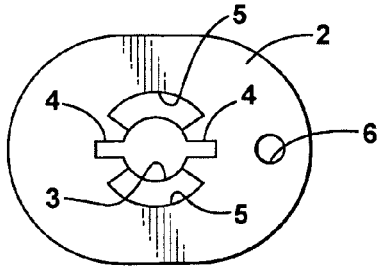
FIG. 3 is a bottom plan view of the base member.
Figure 4:
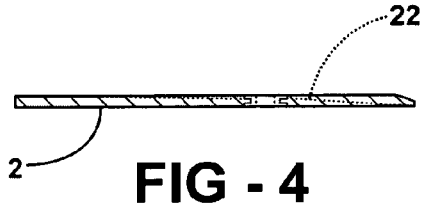
FIG. 4 is a side elevational view of the support base member.

Practice apparatus constructed in accordance with the embodiment shown in FIGS. 1-4 is designated generally by the reference character 1 and comprises a base member 2 having an opening 3 extending therethrough. The opening is cylindrical and communicates on opposite sides thereof with diametrally extending slots 4. Diametrally opposed, circumferentially extending, arcuate grooves 5 are provided in the lower surface of the base member 2. A further opening 6 may be provided, if desired, for attachment of a tether cord (not shown).

The base member 2 is adapted to be used in conjunction with a golf ball-supporting structure 7 comprising an anchor member 8 terminating at one end in an enlargement 9 and tapering to a point 10 at the other end. Between the enlargement 9 and the point 10 the anchor member 8 has a cylindrical stem or shank of such size as slideably to extend through the opening 3 in the base member 2. The cylindrical stem of the anchor member supports a transversely extending retaining pin or lug 11 which, preferably, projects beyond opposite sides of the stem of the anchor member 8. The diameter of the lug 11 is such as to pass through the slots 4 when the lug is in register with the slots, and the length of the lug is such as to enable the latter to be accommodated in the grooves 5 in response to rotation of the stem relative to the base member 2 following passage of the lug 11 through the slots 4. The accommodation of the lug in the grooves 5 retains the stem in the opening 3.

Alternatively, the lug 11 may be replaced by a pair of diametrally extending flanges which extend through the slots 4 for removably coupling the member 8 to the base.

The enlargement 9 at the upper end of the stem is too large to pass through the opening 3 and has in its upper surface a semihemispherical socket 12 which forms part of a joint or coupling between the anchor member 8 and a ball-support member 13. The member 13 terminates at its lower end in a spherical tip 14 which confronts the upper end of the member 8 and is at least partially and rotatably accommodated in the socket 12. The support member 13 terminates at its opposite or upper end in a concave surface 15 of such configuration as to provide support for a golf ball (not shown) in the same way that a conventional tee functions.

The members 8 and 13 are coupled to and biased toward prolongation of each other by a resiliently elastic tubular coupling sleeve member 16 having a body portion 17 which accommodates the majority of the length of the support member 13. That end of the sleeve 16 adjacent its lower end is stretched so as tightly to accommodate and encircle the enlargement 9 of the member 8. At its opposite end the sleeve 16 has a reversely turned portion 19 which forms an annular bead 20 which, in stretched condition, is accommodated in an annular groove 21 in the member 13. The material from which the sleeve 16 is formed is one which is elastically stretchable, pliable, has a high coefficient of friction, and is sufficiently durable as to withstand being struck repeatedly by the head of a moving golf club during the execution of successive golf strokes. Such material may be any selected one of a number of known natural or synthetic rubbers.

The base member 2 is sufficiently thin as to lie flat upon the ground or other surface (such as a mat) at a golf practice facility. Consequently, the base is unlikely to be struck by a moving golf club head. To minimize the likelihood that the base will be struck by a moving club, that edge of the base opposite the direction of movement of the golf club head may be tapered, as is indicated by the dotted line 22 in FIG. 4. The tapered surface also assists in moving a ball onto the bases by a club head.

Figure 5:
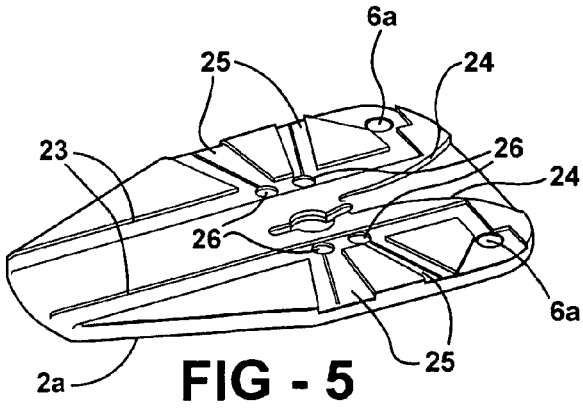
FIG. 5 is an isometric top view of a different embodiment of base member.
Figure 6:
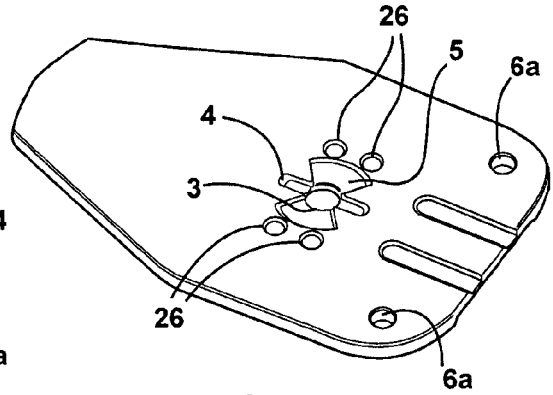
FIG. 6 is an isometric bottom view of the base of FIG. 5.

The embodiment shown in FIGS. 5 and 6 is the same in many respects as that described above and corresponding reference characters identify corresponding parts. In the modified embodiment the base 2*a* has a larger area on the upper surface of which are indicia such as longitudinally extending, parallel lines formed by upstanding ribs 23 which assist a golfer in swinging the head of a golf club along a desired path during the execution of a stroke. Other indicia 24 may be provided at one end of the base for the same purpose. The ribs 23 also form an elongate channel through which a golf ball may roll under the influence of a golf club head.

The upper surface of the base 2*a* also is provided with indicia comprising two groups of lines 25 adjacent opposite edges of the upper surface. The lines of each group diverge in a direction laterally of the base. These indicia are intended to provide the golfer with a guide to facilitate the placing his feet closer together or farther apart, depending upon the club he is using. For example, if the golfer is practicing with a wedge, he will stand closer to the base and with his feet closer to one another than if he is using a longer club such as a driver.

Preferably, the base is provided with two sets of openings 26 on opposite sides of the opening 3 so as to enable corresponding ends of a pair of cords (not shown) to be anchored to and extended laterally from the base. Such cords will form extensions of the indicia 25 and provide additional guidance to the golfer in placing his feet.

The lower surface (FIG. 6) of the base 21 has at one end thereof a pair of parallel grooves which may accommodate the tynes of a ball pitch mark repair tool (not shown). Such tool facilitates separating the base from the ground or a mat.

To condition the apparatus for use, the anchor member 8 is assembled with the base member 2 or 2*a* by registering the lug 11 with the slots 4 and extending the stem of the member 8 through the opening 3. Once the lug 11 has passed through the slots 3, the stem may be rotated through 90° so as to move the lug out of register with the slots 4 and seat the ends of the lug in the grooves 5. The seating of the lug in the grooves 5 prevents tipping of the base if it is placed on a flat surface. The base member then may be placed on the ground or mat and the tip 10 of the anchor member thrust into the ground or mat so as to enable the support member 13 to occupy an upright position with the upper surface 15 at a desired level above ground. A ball then may be placed on the upper surface 15 of the member 13.

Following placement of the ball on the support member 13, the golfer, with a golf club, takes a position to one selected side of the base 2 and makes a stroke with the club so as to cause the head of the club to strike the ball. During this stroke the club head also will strike the support member, either at the rim of the surface 15 or through the sleeve 16. The support 13 will rock relative to the anchor member 8, as permitted by the elastic coupling sleeve. The rocking of the support member 13 will be about the joint between the confronting ends of the members 8 and 13, and the elasticity of the sleeve material 17 will permit, with some resistance, such rocking movement of the member 13. Since some of the energy generated by the swing will be absorbed by the separation and rocking of the member 13 relative to the member 8, the tendency on the part of the ball support and base member 2 to be displaced by the engagement of the club head with the support apparatus at least partially is overcome. If further resistance to displacement of the base member is desired, a tether (not shown) may be anchored to the base member via the opening 6 or 6*a*.

Following rocking of the member 13 relative to the member 8, the elasticity of the sleeve 16 will restore the member 13 to the upright position shown in FIG. 1, thereby conditioning the apparatus to support another ball.

In some cases it may be desirable to remove the anchor member 8 and the ball support member 13 from the base, thereby enabling a golf ball to be moved onto the base and positioned by the opening 3. In this event the golfer may strike the ball in an unteed condition, simulating the striking of a ball on turf. Thus, a ball may be struck for movement along the intended path even though the ball is not in teed condition.

The disclosed embodiments are representative of presently preferred forms of the invention, but are intended to be illustrative rather than definitive thereof. The invention is defined in the claims.

I claim:

1. Golf practice apparatus comprising a base member having length and width dimensions and an opening extending through said base member; an anchor member having a stem, one end of which extends through said opening, said anchor member terminating at a second end thereof in an enlargement; a golf ball support member having a body terminating at one end in a ball-supporting surface and terminating at an opposite end adjacent said second end of said anchor member; and elastic coupling means coupling said anchor member and said golf ball support member to one another with said opposite end of said support member confronting said second end of said anchor member, said coupling means providing a joint between said anchor member and said ball support member and enabling said anchor member and said ball support member to rock relative to one another in response to engagement of said ball support member by a golf club during swinging movement thereof; wherein said enlargement at said end of said stem and said end of said body of said support member form a socket joint.

2. The apparatus according to claim 1 wherein said base member has an upper surface provided with indicia for assisting a golfer using said device to position his feet relative to said device and assisting with swinging a head of a golf club along a desired path during the execution of a stroke.

3. The apparatus according to claim 1 wherein said base member has a thickness dimension which tapers toward one end of said base member.

4. The device according to claim 1 wherein said base member has means for securing one end of a tether cord to said base member.

5. The device according to claim 1 wherein said enlargement forms the socket of said joint.

6. The device according to claim 1 wherein said base has an upper surface provided with ribs forming an elongate channel.

7. The device according to claim 1 wherein said base has a lower surface provided with at least one groove for the accommodation of a ball pitch mark repair tool.

8. The apparatus according to claim 1 wherein said elastic coupling normally exerts a force on said anchor member and said support member biasing such members to positions in prolongation of one another.

9. The apparatus according to claim 1; wherein said coupling comprises a sleeve in which each of said members is at least partially accommodated.

10. The apparatus according to claim 1 wherein one end of one of said members has a socket therein and that end of the other of said members which confronts said one of said members is at least partially accommodated in said socket.

11. The apparatus according to claim 10 wherein that end of said one of said members which is at least partially accommodated in said socket is rotatable relative to said socket.

12. The apparatus according to claim 11 wherein one end of said sleeve accommodates a portion of said anchor member in stretched condition and the opposite end of said sleeve is formed as an annular bead for the accommodation of a portion of said support member.

13. The apparatus according to claim 12 wherein said support member has an annular groove in which said bead is accommodated.

14. The apparatus of claim 1, wherein the base member is sufficiently thin as to lie flat when placed on the ground.

15. The apparatus of claim 1, wherein the stem at one end of the anchor member is integral with the second end of the anchor member.

16. Golf practice apparatus comprising a base member having length and width dimensions and an opening extending through said base member; an anchor member having a stem, one end of which extends through said opening, said anchor member terminating at a second end thereof in an enlargement; a golf ball support member terminating at one end in a ball-supporting surface and terminating at an opposite end adjacent said second end of said anchor member; and elastic coupling means coupling said anchor member and said golf ball support member to one another with said opposite end of said support member confronting said second end of said anchor member, said coupling means providing a joint between said anchor member and said ball support member and enabling said anchor member and said ball support member to rock relative to one another in response to engagement of said ball support member by a golf club during swinging movement thereof; wherein said base member has at least one slot in communication with said opening and extending laterally thereof, said stem of said anchor member having a lug of such dimensions as to pass through said slot when said slot and said lug are in register and said stem occupies said opening, said stem being rotatable in said opening to a position in which said lug is out of register with said extension and underlies said base member thereby retaining said stem in said opening.

17. The apparatus according to claim 16 wherein said base member has at least one recess adjacent said opening for the accommodation of said lug when said lug is rotated to a position out of register with said slot.

18. Golf practice apparatus comprising:

(a) a base member having length and width dimensions and comprising a pair of spaced apart and parallel ribs extending along the length dimension forming parallel lines and an elongate channel adapted to allow for a golf ball to roll through the elongate channel under the influence of a golf club head, the base member defining an opening extending through said base member, wherein the opening is adapted to receive an anchor member engaged with a ball support member and an elastic coupling means;

(b) at least one slot in communication with said opening and extending laterally thereof adapted to receive a lug or flanges of such dimensions as to pass through said slot when said slot and said lug or flanges are in register and said stem occupies said opening, said stem being rotatable in said opening to a position in which said lug or flanges are out of register with said extension and underlies said base member thereby retaining said stem in said opening, (c) at least one recess adjacent said opening defined on a bottom side of said base member and adapted for accommodation of the lug or flanges when said lug or flanges are rotated to a position out of register with said slot.

19. The apparatus according to claim 18 wherein said base member has an upper surface provided with indicia for assisting a golfer using said device to position his feet relative to said device and assisting with swinging a head of a golf club along a desired path during the execution of a stroke.

20. The apparatus according to claim 18 wherein said base member has a thickness dimension which tapers toward one end of said base member defining a tapered surface.

21. The apparatus according to claim 20 wherein the tapered surface of the base member is adapted to assist in moving a ball onto the base by a club head.

* * * * *